US005672046A

United States Patent [19]

Dittmar

[11] Patent Number: 5,672,046

[45] Date of Patent: Sep. 30, 1997

[54] SIDE-CHANNEL COMPRESSOR

[75] Inventor: Rudi Dittmar, Helmers, Germany

[73] Assignee: Siemens Aktiengesellschaft, Munich, Germany

[21] Appl. No.: 710,886

[22] Filed: Sep. 24, 1996

[30] Foreign Application Priority Data

Oct. 6, 1995 [DE] Germany ..... 195 37 353.7

[51] Int. Cl.[6] ..... F04D 5/00

[52] U.S. Cl. ..... 415/55.1; 415/55.4

[58] Field of Search ..... 415/55.1, 55.4

[56] References Cited

U.S. PATENT DOCUMENTS

| | | | |
|---|---|---|---|
| 3,356,033 | 12/1967 | Ullery | 415/55.4 |
| 3,734,638 | 5/1973 | Ebsary | 415/55.4 |
| 3,942,906 | 3/1976 | Schonwald | 415/55.4 |
| 3,982,848 | 9/1976 | Schonwald et al. | 415/55.4 |
| 5,163,810 | 11/1992 | Smith | 415/55.4 |

FOREIGN PATENT DOCUMENTS

| | | |
|---|---|---|
| 1 428 251 | 1/1969 | Germany . |
| 2 279 409 | 1/1995 | United Kingdom . |

*Primary Examiner*—John T. Kwon
*Attorney, Agent, or Firm*—Kenyon & Kenyon

[57] ABSTRACT

A side-channel compressor is disclosed with at least one side channel configured in the compressor housing and with a baffle, separating the intake and delivery sides. The boundary sides of the baffle extend in the radial direction with respect to the side channel and have a profile deviating from the axial direction of the compressor. Good noise damping without negative effects on the characteristic curve of the compressor can be achieved by the boundary sides of the baffle being equipped over their entire radial height with an at least approximately heart-shaped indentation, with the indentations provided on the intake and delivery sides having tips facing each other.

7 Claims, 2 Drawing Sheets

SIDE-CHANNEL COMPRESSOR

FIELD OF THE INVENTION

The present invention relates to a side-channel compressor. In particular, it relates to a side-channel compressor with at least one side channel configured in the compressor housing and with a baffle separating the intake and delivery sides whose boundary sides extend in the radial direction with respect to the side channel.

BACKGROUND OF THE INVENTION

A compressor of this type is disclosed in DE-B-14 28 251. In this compressor, the boundary edges of the baffle, which extend radially with respect to the side channel, are inclined obliquely with respect to the rotation axis of the compressor. Although this oblique positioning of the boundary edges achieves a reduction in noise, the pressure characteristic curve of the compressor is unfavorably influenced.

OBJECTS AND SUMMARY OF THE INVENTION

It is an object of the invention to develop a side-channel compressor that achieves good noise damping without negative effects on the characteristic curve of the compressor.

In accordance with the invention, this object is achieved by means of a side-channel compressor in which the boundary sides of the baffle are provided over their entire radial height with an at least approximately heart-shaped indentation with the tips of the indentations provided on the intake and delivery sides facing each other. The heart-shaped indentations provide excellent damping of blade sounds resulting from the number of blades and the rotation speed of the impeller, without having repercussions on the characteristic curve of the compressor.

An opening angle for the tips of the heart-shaped indentations of less than 25° has proven particularly favorable.

If the housing of the side-channel compressor consists of two housing halves that can be joined to one another, it is then advantageous if the indentations are configured symmetrically with respect to the axial center of the baffle. It is then possible to configure both housing halves identically. Moreover the indentation sides of the heart-shaped indentations extending to the tip can optionally be reconfigured.

In accordance with another embodiment, the indentations are arranged mutually outside the axial center of the baffle.

In accordance with yet another embodiment, the rounded top regions of the heart-shaped indentations extending toward the axial boundary edges of the baffle are offset from one another in the circumferential direction.

In accordance with a further embodiment, only one of the indentation sides leading to the tip of the heart-shaped indentation is curved; the other indentation side is configured in a straight line.

With regard to the rounded portions of the heart-shaped indentations, it has proven advantageous that the magnitude of the radius of the curves of the heart-shaped indentations corresponds to between one-half and all of the lateral distance from the tip to the respective axial boundary edge of the baffle.

BRIEF DESCRIPTION OF THE DRAWINGS

The invention will be described in greater detail below with reference to exemplified embodiments depicted in the drawings, in which.

DETAILED DESCRIPTION

Figure 1:
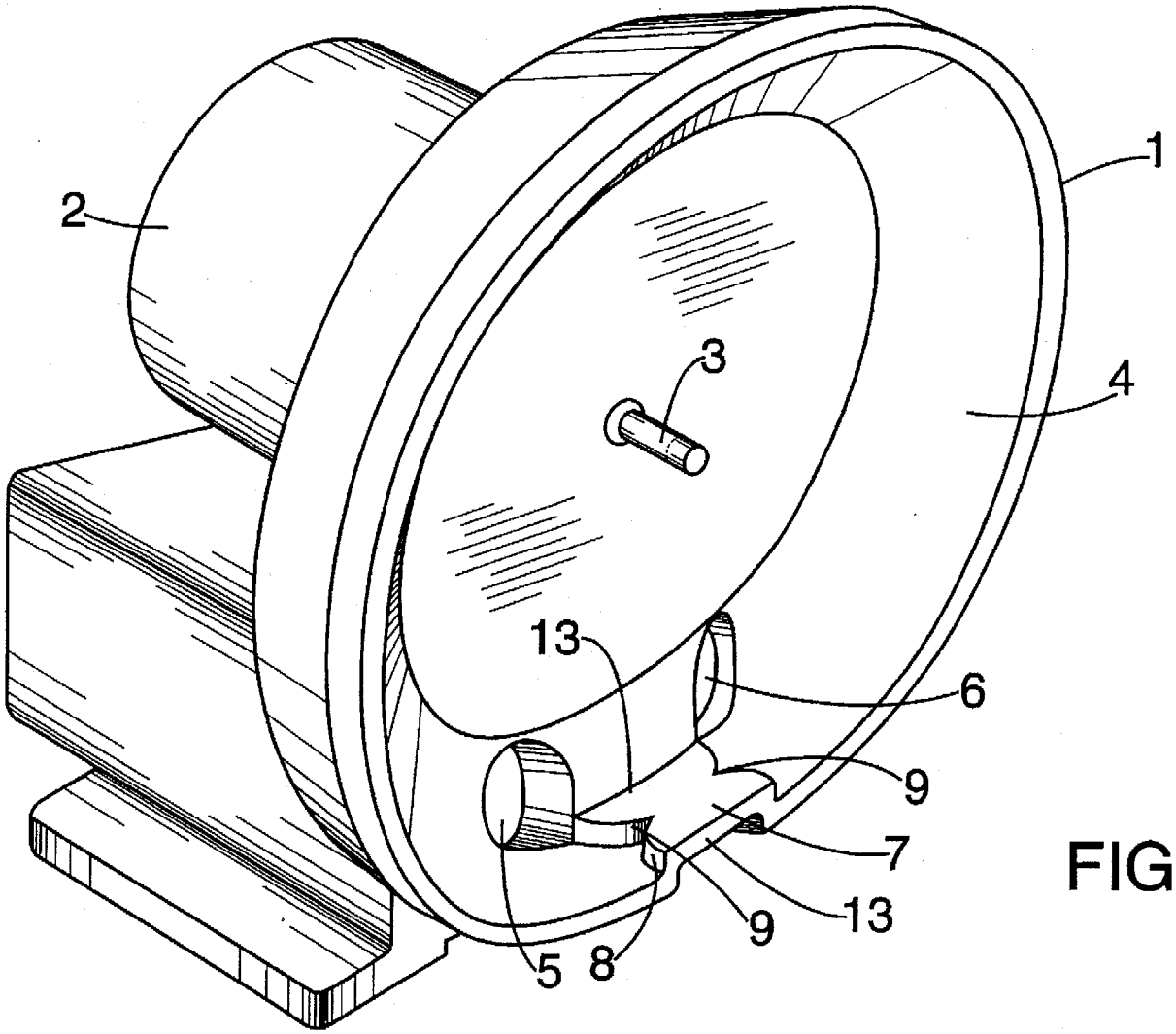
FIG. 1 is a perspective view of a side-channel compressor with an open side wall.

Reference numeral 1 designates the compressor housing of a side-channel compressor. Flange-mounted onto this housing 1 is a drive motor 2, on whose shaft 3 the impeller (not depicted in the drawing) of the compressor is arranged. A side channel 4 is shaped in a known manner in compressor housing 1. Provided between the inlet and outlet orifices 5 and 6 opening respectively into side channel 4 is a baffle 7, which separates the intake and delivery sides of the compressor from one another. Boundary sides 8 of the baffle 7, which extend radially with respect to side channel 4, each have a heart-shaped indentation 9.

Figure 2:
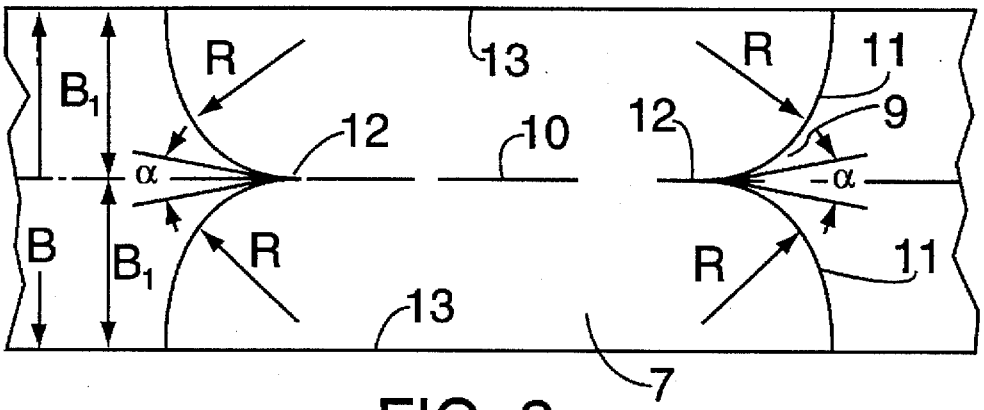
FIGS. 2–5 are top plan views of various baffles illustrating various embodiments of heart-shaped baffle indentations.

In the exemplified embodiment shown in FIG. 2, the heart-shaped indentations 9 lying on the intake side and on the delivery side are configured symmetrically with respect to the axial center 10 of the baffle 7. The radius R of rounded regions 11 of heart-shaped indentations 9 is selected to be somewhat less than the lateral distance B1 between the tip 12 of heart-shaped indentations 9 and the respective axial boundary edge 13 of baffle 7. When heart-shaped indentations 9 are configured symmetrically with respect to axial center 10 of baffle 7, radius R is thus less than half the axial width B of baffle 7.

The opening angle $\alpha$ of the tip 12 of each heart-shaped indentation 9 is less than 25 degrees.

Figure 3:
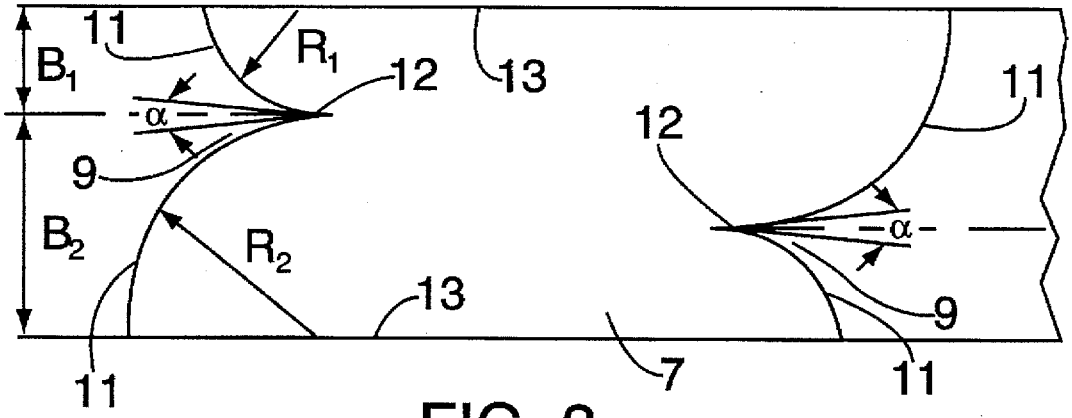

The exemplified embodiment according to FIG. 3 shows an eccentric arrangement of heart-shaped indentations 9. Different lateral distances B1 and B2 between the tip 12 and the axial boundary edges 13 of the baffle 7 thus result. The radii R1 and R2 of rounded regions 11 are selected to be equal to the respective lateral distance B1 or B2. Moreover, rounded regions 11 of each heart-shaped indentation 9 are offset in the circumferential direction from one another. This type of configuration of the baffle 7 acts as a boundary side 8 extending obliquely with respect to the rotation axis. The conveying blades of the impeller, oriented parallel to the rotation axis, thus overlap even more continuously into the baffle region.

Figure 4:
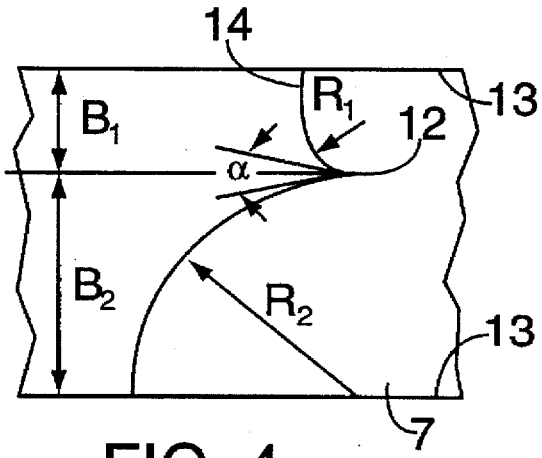

In the embodiment of FIG. 4, the radius R1 selected for one rounded region 11 is smaller with respect to the lateral distance B1 than in the embodiment of FIG. 3. This results, in the transition from the rounded region to boundary edge 13, in a subregion 14 of boundary side 8, which extends in a straight line.

Figure 5:
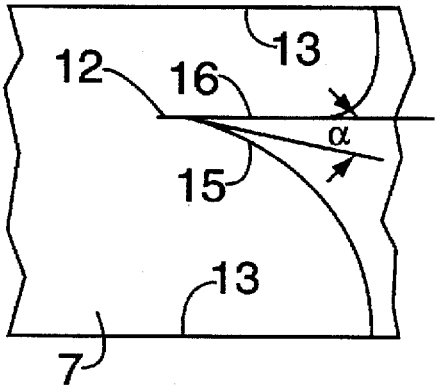

FIG. 5 illustrates a variation in the contour of heart-shaped indentation 9. In this exemplified embodiment, one indentation side 15 extends in a curve. The other indentation side 16, however, has a straight-line profile.

With these different embodiments, it is possible, depending on the particular design of the side-channel compressor—i.e. on its blade sound which depends in each case on the number of blades and the rotation speed of the impeller—to achieve optimization in noise reduction without detrimental repercussions in the characteristic curve of the compressor.

What is claimed is:

1. A side-channel compressor, comprising:

a compressor housing having at least one side channel; and a baffle separating intake and delivery sides of the side channel, said baffle having boundary sides extending in a radial direction with respect to the side channel, and having a profile deviating in the axial direction of the compressor, said boundary sides of the baffle each including an approximately heart-shaped indentation extending over an entire radial height of the boundary side, the indentations being provided on the intake and delivery sides and having tips facing each other.

2. The side-channel compressor of claim 1, wherein the tips include an opening angle $\alpha$ of less than 25°.

3. The side-channel compressor of claim 1, wherein the indentations are symmetrical with respect to an axial center of the baffle.

4. The side-channel compressor of claim 1, wherein the indentations are arranged mutually outside the axial center of the baffle.

5. The side-channel compressor of claim 1, wherein the heart-shaped indentations include rounded regions extending toward the axial boundary edges of the baffle and are offset from one another in a circumferential direction.

6. The side-channel compressor of claim 1, wherein the heart-shaped indentations include sides leading to the tip, and wherein one of the indentation sides is curved, and the other indentation side extends along a straight line.

7. The side-channel compressor of claim 1, wherein the heart-shaped indentations include rounded regions, and the magnitude of the radius of the rounded regions corresponds to between one-half and all of the lateral distance between the tip and the respective axial boundary edge of the baffle.

* * * * *